United States Patent [19]

Halvig

[11] Patent Number: 4,664,372

[45] Date of Patent: May 12, 1987

[54] BICYCLE-TYPE EXERCISE MACHINE

[76] Inventor: Melvin W. Halvig, Almond St., Paradise, Calif. 95969

[21] Appl. No.: 881,516

[22] Filed: Jun. 30, 1986

Related U.S. Application Data

[63] Continuation-in-part of Ser. No. 670,877, Jun. 21, 1985, abandoned.

[51] Int. Cl.[4] ..... A63B 23/04

[52] U.S. Cl. ..... 272/73; 272/135

[58] Field of Search ..... 272/73, 72, 135, 142, 272/146

[56] References Cited

U.S. PATENT DOCUMENTS

| | | | |
|---|---|---|---|
| 593,943 | 11/1897 | Kingsland | 272/73 |
| 1,872,256 | 8/1932 | Danney | 272/73 |
| 2,388,777 | 11/1945 | Wentz | 272/73 |
| 3,911,908 | 10/1975 | Duke | 272/73 |
| 3,968,963 | 7/1976 | Seiko | 272/73 |
| 3,995,491 | 12/1976 | Wolfla, II | 272/73 |
| 4,265,447 | 5/1981 | Shafer | 272/73 |
| 4,351,527 | 9/1982 | Crisp, Jr. | 272/142 X |
| 4,390,177 | 6/1983 | Biran et al. | 272/73 |

FOREIGN PATENT DOCUMENTS

| | | | |
|---|---|---|---|
| 453982 | 6/1968 | Switzerland | 272/73 |
| 461839 | 10/1968 | Switzerland | 272/73 |

*Primary Examiner*—Richard J. Apley
*Assistant Examiner*—J. Welsh

[57] ABSTRACT

The invention provides a dual-purpose exerciser machine including pedal and flywheel mechanics for foot and leg exercising and handle mechanics with resistance for pull up arm and shoulder exercising. The exerciser is compacted into a grip-sized housing affixed with a carrying handle for portability.

4 Claims, 6 Drawing Figures

BICYCLE-TYPE EXERCISE MACHINE

This application is a continuation-in-part of Ser. No. 670,877, filed June 21, 1985, now abandoned.

BACKGROUND OF THE INVENTION

This invention relates to portable exercising devices. It is particularly directed towards dual-purpose exercisers having mechanics for foot, leg, and arm use at the same time.

Various devices seen in patents issued used chain and sprocket type exercisers. Combination leg and arm exercisers are prominent in past art development and basic bicycle pumping mechanisms are used in many applications.

The Wentz U.S. Pat. No. 2,388,777, issued Nov. 13, 1945, illustrates a basic pole held pedal device for chair use. The Swiss Pat. No. 461839, Fram, Oct. 10, 1968, puts a crank-pedal exerciser on a stand adaptable for a variety of exercising situations. In a patent issued to Duke, U.S. Pat. No. 3,911,908, dated Oct. 14, 1975, a chain and sprocket is arranged for attachment to a chair. The Sileo device seen in U.S. Pat. No. 3,968,963, July 13, 1976, shows a tubular frame with support legs and a simple crank-pedal device also useful with a chair. An automotive use device is illustrated in the Shafer U.S. Pat. No. 4,265,447, dated May 5, 1981, which is a combination seat tray and exercising apparatus using a double crank and flywheel arrangement. And an interesting folding pedal crank exercising device is seen in U.S. Pat. No. 4,390,177, dated June 28, 1983, and issued to Biran et al. The listed patents were examined for state-of-the-art status of the present invention.

None of the seen chain and sprocket exercisers illustrated in the prior art appear to have developed the sophisticated operation and the variety of useful applications attributable to the present invention.

OBJECTS OF THE INVENTION

Therefore, it is a principal object of this invention to provide an excercising device useful to the passenger of an automobile confined to the seat on long trips.

A further object of the invention is to provide a duel-purpose device for exercising both the legs and the arms from a setting position.

A still further object of the present invention is to provide a highly portable exercising unit with housing and a handle for carrying.

Another object of this invention is to provide a pedal type exerciser having a resistant pull up handle for exercising the user's arms, shoulders, and back muscles.

A further object of the invention is to provide a portable exercising machine which can be used in convalesant homes, hospitals, and is especially adaptable for use by people confined to wheelchairs.

Many other objects and advantages of the present invention will become apparent from reading the following description and considering the specification in conjunction with the accompanying drawings and the numbered parts thereon.

SUMMARY OF THE INVENTION

To carry out my invention, I have provided a portable exerciser machine with housing and carrying handle. The device is pedal oriented with an adjustible belt biased flywheel. A chain and sprocket arranged with pedals structured on a floor base allows for a variety of foot and leg exercises. The device is designed for use while riding as a passenger in an automobile, while sitting in a wheel chair, and while sitting in a chair or on a stool. A telescoping handle with cross bar and handle grips is arranged as a control for tightening and loosening the flywheel belt for desired tension on the flywheel. The handle can be pulled up and down against an internal extension spring for arm and shoulder exercising.

DESCRIPTION OF THE PREFERRED EMBODIMENT

Figure 1:
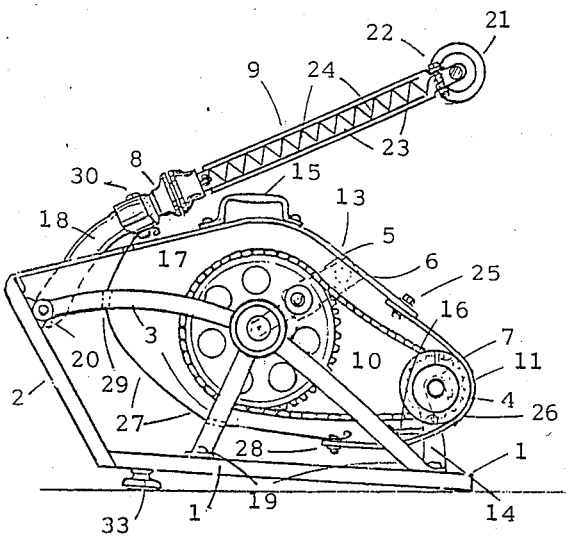
FIG. 1 is a side view of my exerciser machine in open line drawing to illustrate the framework and internal operational parts of the device.
Figure 4:
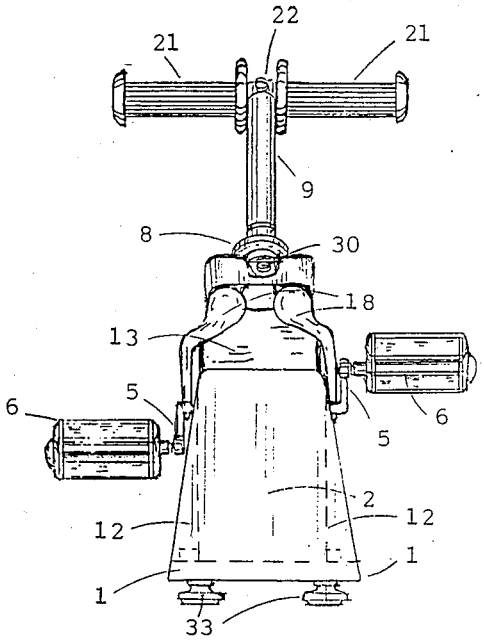
FIG. 4 shows my exerciser from the front.
Figure 2:
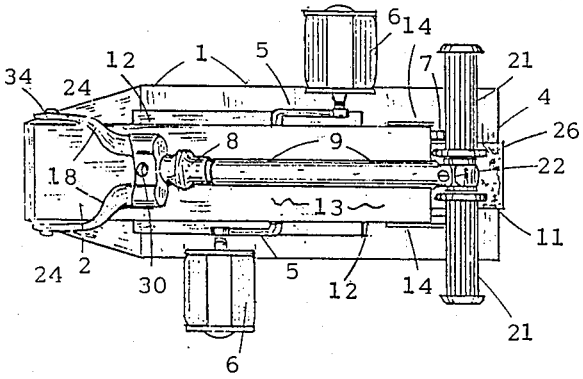
FIG. 2 shows the exerciser in a top plan view.

Referring now to the drawings at FIG. 1 where the exercising machine is illustrated by an open line drawing in a side view. Base platform 1 having an upwardly and forwardly slanted front plate 2 is affixed with support structure 3 mounted to base platform 1 and to front plate 2 for supporting a sprocket 7 having a crank 5 with a pedal 6 which extend from both sides of sprocket 7. Supporting structure 3 supports flywheel 11. Sprocket 7 is rotatably connected to flywheel 11 by chain 10 to turn flywheel 11. A cover frame including a top 13 and sides 12 encloses the supporting structure 3, the sprocket 7, and the chain 10. A front forked-handle 8 is telescopic and has an internal spring 24 to resist telescopic separation of handle extension 9 at inner handle position 23 when a pull is applied on handle grips 21. Forked-handle 8 is pivotally mounted to frame 3 by handle fork 18 fitted across cover 13 adjacent front plate 2 through sides 12 protected by fork shield washers 34. A flywheel brakaing assembly includes a belt 26 attached at one end to the cover frame top 13 and frictionally engages flywheel 11 when a cable 27 attaching the other end of belt 26 to pivitol forked-handle 8 is pulled by the movement of forked-handle 8 being pivoted upwardly. As forked-handle 8 is pivoted upwardly the tension of belt 26 is increased thereby increasing the amount of braking applied to flywheel 11.

Flywheel 11 is supported by flywheel sprocket 7 mounted adjustably on chain adjustment mounts 14 affixed to frame 3. Chain adjustment mounts 14 are useful for maintaining pressure on chain 10 and for the removal of chain 10. The portable exerciser machine of this invention is user adjustable in having adjustable elevating legs 33 affixed on the bottom side of base platform 1 for raising and lowering the front plate 2 end of the machine to a desired position. The portability of the invention is further enhanced by a carrying handle 14 mounted on the top side of cover 13.

Figure 5:
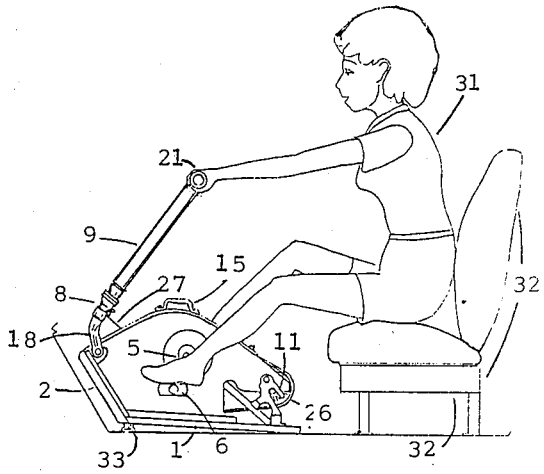
FIG. 5 illustrates my exerciser machine being used for foot and leg exercising by a person sitting on the seat of an automobile.
Figure 3:
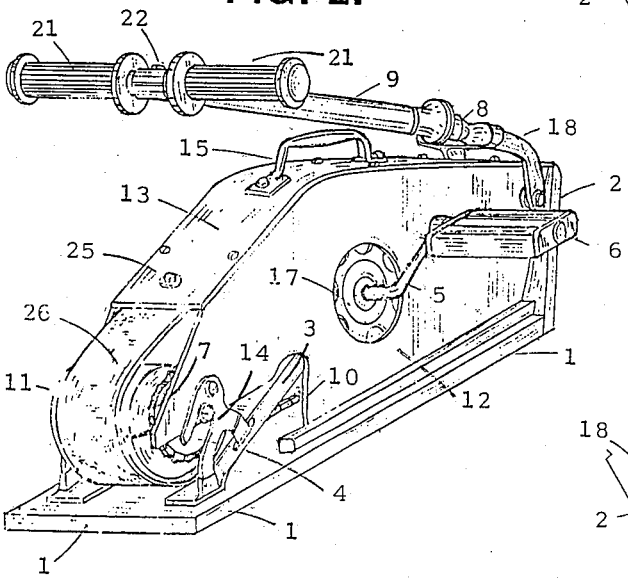
FIG. 3 is a perspective drawing of the exerciser machine.
Figure 6:
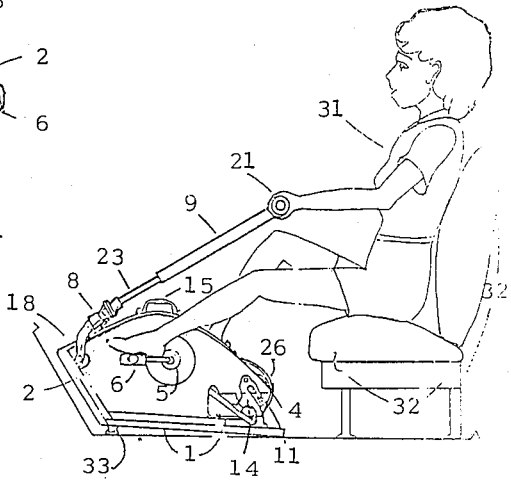
FIG. 6 shows the automobile passenger using the spring-biased, telescoping handle for arm and chest exercising..

The embodiment herein described is portable and can be used in various locations. A particular function is the relief of passagner fatigue during long automotive confinement. For automotive use, illustrative user 31 sets on auto seat 32 and pumps pedals 6 with her feet. The turning of pedals 6 activates cranks 5 and flywheel 11 is turned by chain 10 through chain and sprocket action of crank sprocket 17 and hub sprocket 7 affixed to hub 4 of flywheel 11. The pumping action gives user 31 foot and leg exerice as shown in FIG. 5. User 31 can increase tension applied to flywheel 11 by pushing forward on handle grips 21 to move pivoted handle 8 upwardly which pulls cable 27 to tighten tension belt 26 on flywheel 11. Shoulder and chest exercises may be accomplished by pulling upward on handle grips 21 which pulls telescoping handle extension 9 along inner handle section 23 and activates tension spring 24. Tension spring 24 is affixed internally to handle 8 and attached at spring retainer bolt 22 centrally between handle grips 21. Releasing handle grips 21 allows tension spring 24 to return the telescoping handle to a closed position. FIG. 6 illustrates the use of this exercising machine for shoulder and arm exercises.

I claim:

1. A portable exerciser machine with mechanics for foot and leg exercising and mechanics for arm and shoulder exercising, comprising: a base platform with an upwardly and forwardly slanted front plate; a support structure mounted to said base platform and said front plate for supporting a sprocket having a crank with a pedal, extending from both sides of said sprocket and for supporting a flywheel; said sprocket being rotatably connected to said flywheel by a chain to turn said flywheel; a cover frame including a top and sides for enclosing the support structure, sprocket and chain; a front forked-handle pivotally mounted adjacent the front plate; said handle being telescopic and including an internal spring to resist telescopic separation; and a flywheel braking assembly comprising a belt, attached at one end to said cover frame, to frictionally engage said flywheel and a cable attaching the other end of said belt to said pivot handle, where as said handle is pivoted upwardly the tension of the belt is increased thereby increasing the amount of braking applied to the flywheel.

2. The portable exerciser machine described in claim 1, wherein said flywheel is supported by a flywheel sprocket which is adjustable on said support structure for maintaining pressure on said chain and for removal of said chain.

3. The portable execiser machine of claim 1, having adjustable elevating legs affixed on the bottom side of said base platform for raising and lowering the front plate end of the machine.

4. The portable exerciser machine of claim 1, having a handle mounted on said cover frame for carrying the machine.

* * * * *